United States Patent [19]

Jensen

[11] Patent Number: 4,984,850

[45] Date of Patent: Jan. 15, 1991

[54] LINEAR IMPACT RIPPER APPARATUS

[75] Inventor: Brian D. Jensen, Dunlap, Ill.

[73] Assignee: Caterpillar Inc., Peoria, Ill.

[21] Appl. No.: 430,544

[22] Filed: Nov. 2, 1989

[51] Int. Cl.[5] ..... E21C 3/04; B25D 17/24

[52] U.S. Cl. ..... 299/37; 37/DIG. 18; 173/139; 173/162.1

[58] Field of Search ..... 299/14, 36, 37, 69; 172/40; 37/DIG. 18; 173/139, 161.1, 161.2

[56] References Cited

U.S. PATENT DOCUMENTS

| | | | |
|---|---|---|---|
| 4,133,394 | 1/1979 | Wohlwend | 173/139 |
| 4,679,857 | 7/1987 | Roussin et al. | 299/37 |
| 4,724,912 | 2/1988 | Miyazaki et al. | 173/162.1 |
| 4,834,461 | 5/1989 | Fidler et al. | 299/37 |

FOREIGN PATENT DOCUMENTS

| | | | |
|---|---|---|---|
| 1538806 | 1/1979 | Fed. Rep. of Germany | 299/37 |
| 50-111106 | 9/1975 | Japan . | |
| 51-56002 | 5/1976 | Japan . | |

*Primary Examiner*—Ramon S. Britts
*Assistant Examiner*—David J. Bagnell
*Attorney, Agent, or Firm*—Calvin E. Glastetter

[57] ABSTRACT

Impact rippers are useful, for example, in fracturing rock and other hard material which is to be excavated. Known systems using structures which mount the impact hammer and the linear ram within a single housing transmit vibrations into the mounting frame and are difficult to service and expensive to maintain. The subject linear impact ripper apparatus has an impact hammer having one end resiliently mounted to a mounting frame and another end slidably mounted on one of the linear ram and the tool holder. Thus, the disclosed linear impact ripper apparatus reduces vibrations transmitted to the mounting frame and has separate elements for ease of service and reduced maintenance cost and maintains the alignment between the separate parts of the structure. The arrangement allows the connection between the impact hammer and one of the linear ram and the tool holder to be sealed from atmosphere.

7 Claims, 3 Drawing Sheets

LINEAR IMPACT RIPPER APPARATUS

DESCRIPTION

1. Technical Field

This invention relates generally to impact rippers, and more particularly, to the interconnection and arrangement of a linear ram within a tool holder and an impact hammer.

2. Background Art

Impact rippers are commonly used to deliver a combination of drawbar loading and high energy impact blows for fracturing rock, coal, shale, cement, and so forth. One example of such use involves positioning an impact hammer relative to a linear ram wherein impact blows from the impact hammer are delivered to the linear ram and thus to the ripper tip and the material being ripped In another example a linear ram and an impact hammer are positioned within a housing that is pivotally attached to the support structure. One of the problems associated with such an arrangement having both the linear ram and the impact hammer mounted in a single housing or separate housings which are rigidly interconnected is that impact vibrations are transmitted into the mounting frame. Another problem is difficulty of performing service. The impact hammer and housing which holds the tool must be removed as a unit to perform the service. Another problem would be higher maintenance cost. If the housing is damaged or worn by the material, the housing would need to be replaced The present invention is directed to overcoming one or more of the problems as set forth above.

DISCLOSURE OF THE INVENTION

In one aspect of the present invention, an impact ripper apparatus is provided. The impact ripper apparatus includes a mounting frame. A tool holder has a first end portion and a second end having a bore therethrough. The first end portion is attached to the mounting frame. A linear ram is reciprocatingly supported within the bore. An impact hammer has a piston coaxially aligned with the bore, a first end portion mounted to the mounting frame, and a second end portion resiliently mounted on one of the linear ram and the tool holder. The impact hammer is arranged and positioned to deliver impact blows to the linear ram.

The present invention provides a linear impact ripper apparatus which resiliently mounts one end of the impact hammer on the mounting frame and the other end on one of the linear ram and the tool holder. The impact hammer being resiliently mounted will reduce the vibrations which are transmitted to the mounting frame. Also the impact hammer and the tool holder are separate elements and can be removed separately for ease of service. If the tool holder is damaged or worn by the material, only the tool holder needs to be replaced. Thus transmitted vibrations, service time, and maintenance cost will be reduced while maintaining the alignment between the impact hammer and the tool holder.

BEST MODE FOR CARRYING OUT THE INVENTION

Figure 1:
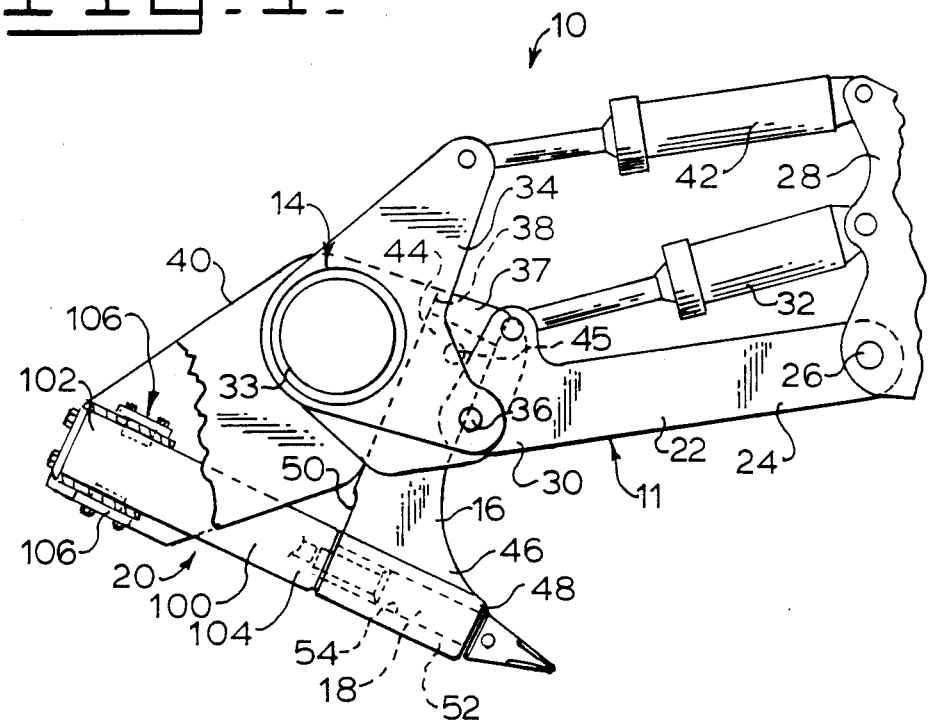
FIG. 1 is a side view of an impact ripper apparatus which embodies the present invention.
Figure 2:
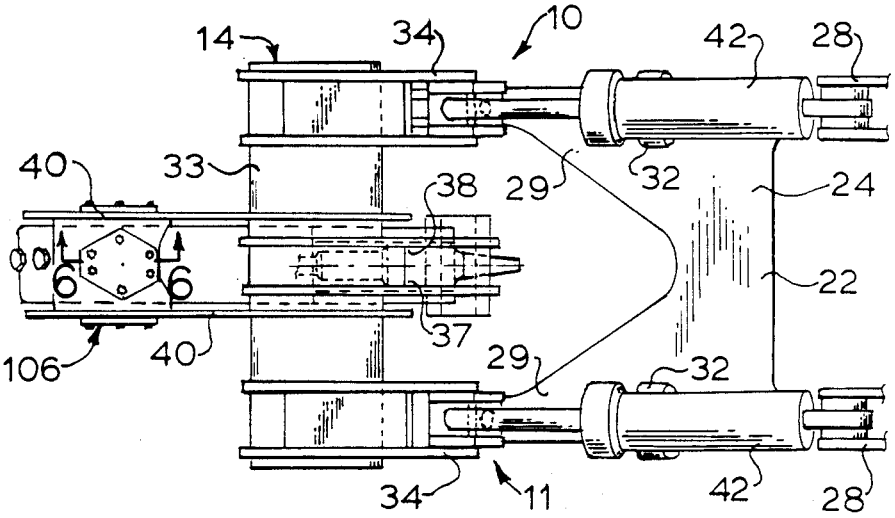
FIG. 2 is a plan view of an impact ripper apparatus which embodies the present invention.

A linear impact ripper apparatus 10 is shown in association with a support structure 11 and includes a mounting frame 14, a tool holder 16, a linear ram 18, and an impact hammer 20.

The support structure 11 includes a support frame 22. The support frame 22 has a first end portion 24 pivotally attached by a pair of pins 26 to a bracket 28 on a vehicle (not shown). The support frame 22 includes a pair of rearwardly projecting transversely spaced legs 29 defining a second end portion 30 of the support frame 22. A pair of hydraulic cylinders 32 extend between the bracket 28 and the second end portion 30 of the support frame 22 to elevationally position the support frame 22.

The mounting frame 14 includes a crossbeam 33 and a pair of end support structures 34 mounted on laterally spaced opposite ends of the crossbeam and being pivotally attached by a pair of pins 36 to the second end portion 30 of the support frame 22. The mounting frame 14 further includes a first support structure 37 having a mounting slot 38 therethrough. A pair of spaced apart second support plates 40 are mounted on the mounting frame 14, one on each side of the first support structure 37. A pair of spaced apart mounting plates 41 are positioned between and welded to the second support plates 40. A pair of hydraulic cylinders 42 are positioned between each of the end support structures 34 and the bracket 28 to pivot the mounting frame 14 about the pins 36.

Figure 3:
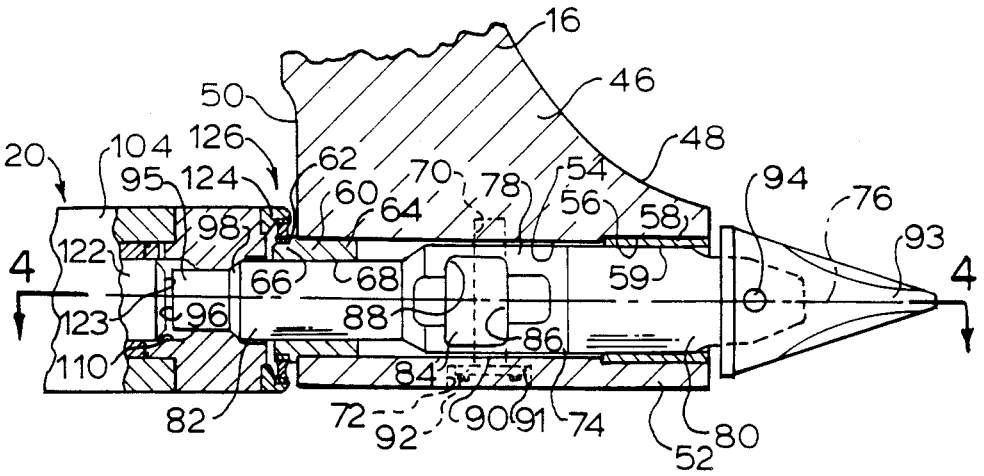
FIG. 3 is an enlarged partial sectional side view of a portion, of the impact ripper apparatus.
Figure 4:
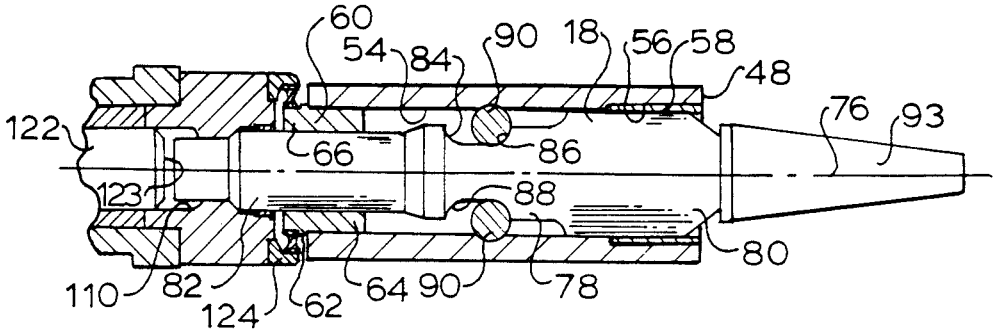
FIG. 4 is a partial sectional view taken along line 4—4 of FIG. 3.

The tool holder 16 has a first end portion 44 positioned and fixedly attached by a pin 45 within the mounting slot 38 of the first support structure 37. A second end portion 46 of the tool holder 16 projects downwardly therefrom. As best shown in FIG. 3, the tool holder 16 includes a front material engaging edge 48, a rear edge 50, and a bottom surface 52. A bore 54, in the second end portion 46, extends therethrough from the front edge 48 to the rear edge 50. The bore 54 has a counterbore 56 extending from the front edge 48 rearward a predetermined distance. A first or front bearing 58 is positioned within the counterbore 56 and has a bore 59 which has an inside diameter smaller than the bore 54. A second or rear bearing 60 is positioned within the bore 54 opposite the first bearing 58. The rear bearing 60 has an annular outside flange 62 positioned to engage the rear edge 50 of the tool holder 16. The rear bearing 60 includes a end portion 66 extending rearwardly a predetermined distance from the annular flange 62. A central bore 68 extends through the rear bearing 60. A pair of spaced bores 70 having counterbores 72 extend upwardly a predetermined distance from the bottom surface 52 into the tool holder 16 and intersect the bore 54 at opposite sides thereof.

The linear ram 18 is reciprocatingly supported within the bores 59,68 of the front and rear bearings 58,60 within the bore 54 of the tool holder 16. The linear ram 18 has an axis 76, a central portion 78, a first end portion 80, and a second end portion 82. The central portion 78 includes a pair of grooves 84, one on each side of the linear ram 18. A front stop 86 is formed by one of the sidewalls of the grooves 84. A rear stop 88 is formed by the other one of the sidewalls of the grooves 84. A pair of stop pins 90, one in each of the spaced bores 70, are positioned in the grooves 84 to limit fore and aft movement and rotation of the linear ram 18. A pair of cover plates 91, one in each of the counterbores 72 of spaced bores 70, are attached to the tool holder 16 by a plurality of bolts 92 to retain the stop pins within the bores 70. The first end portion 80 of the linear ram 18 extends beyond the front edge 48 and receives a replaceable material engaging tip 93 retained on the linear ram 18 by any suitable retainer, in this embodiment a pin 94. The second end portion 82 of the linear ram 18 extends beyond the rear edge 50 and the rear bearing 60. The second end portion 82 has a reduced diameter portion 95 having an end impact surface 96. A shoulder 98 on the linear ram 18 is positioned between the end impact surface 96 and the rear bearing 60.

Figures 5, 6:
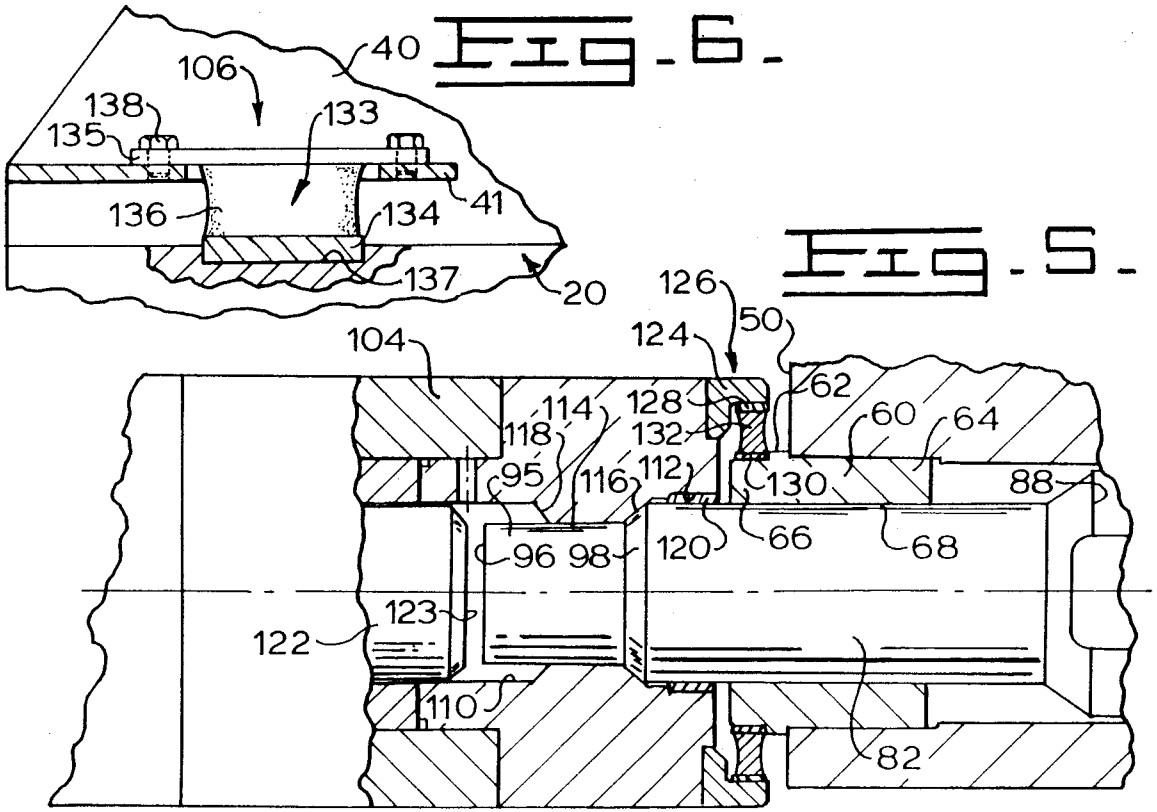
FIG. 5 is an enlarged sectional view of a portion of FIG. 3
FIG. 6 is a partial sectional view taken along line 6—6 of FIG. 2.

The impact hammer 20 has a housing 100 having a first end portion 102 and a second end portion 104. A plurality, in this embodiment four, of mounting structures 106 resiliently support the first end portion 102 of the housing 100 on the mounting frame 14. As best shown in FIG. 5, the housing 100 has a stepped central bore 110 and a counterbore 112 at the second end portion 104 of the housing 100. The stepped central bore 110 is coaxially aligned with the bore 54 of the tool holder. A reduced diameter portion 114 in the bore 110 is spaced rearwardly a predetermined distance from the counterbore 112. A front stop 116 is formed by one sidewall of the reduced diameter portion 114. A rear stop 118 is formed by the other sidewall of the reduced diameter portion 114. A sleeve bearing 120 is attached, in this embodiment by an interference fit, within the counterbore 112 of the second end portion 104 of the housing 100 and slidably receives the rearwardly extending second end portion 82 of the linear ram 18. The second end portion 104 of the housing 100 alternatively could be mounted on the tool holder 16. A piston 122 has an impact surface 123 and is slidably positioned within the central bore 110 rearward of the annular shoulder 114. An annular ring 124 is attached to the second end portion 104 of the impact hammer 20 and projects forwardly therefrom. A shear seal 126 includes an outer; ring 128, an inner ring 130, and an elastomeric ring 132 bonded between outer ring 128 and inner ring 130. The outer ring 128 of the shear seal 126 is attached, in this embodiment by an interference fit, to the annular ring 124 of the impact hammer 20. The inner ring 130 of the shear seal 126 is attached, in this embodiment by an interference fit, to the extending portion 66 of the rear bearing 60 of the tool holder 16. The shear seal 126 seals the internal areas of the impact hammer 20 and the connection between the impact hammer 20 and the linear ram 18 from atmosphere and also deflects to allow the impact hammer 20 to move.

Each of the mounting structures 106, the upper one is shown in FIG. 6, includes a resilient support assembly 133. The support assembly 128 includes a first plate 134, a second plate 135, and a elastomeric pad 136 bonded between the first and second plates 134, 135. The first plate 134 is positioned in a slot 137 in the housing 100 of the impact hammer 20. The second plate 135 is removably attached, in this embodiment to the upper one of the pair of spaced mounting plates 41 between the pair of second support plates 40, by a plurality of bolts 138. The plurality of mounting structures are identical; however, the mounting structures positioned on each side of the impact hammer are removably attached one to each of the spaced apart second support plates 40 instead of being attached to either of the spaced apart mounting plates 41. The mounting structure positioned below the impact hammer is mounted to the lower one of the pair of spaced mounting plates 41.

INDUSTRIAL APPLICABILITY

In the use of the impact ripping apparatus 10, the linear ram 18 is shown in the retracted position it would occupy immediately before it is impacted by the piston 122 of the impact hammer 20. The first end portion 102 of the impact hammer 20 is resiliently mounted on the mounting frame 14 to reduce vibrations transmitted to the mounting frame 14. The second end portion 104 is slideably mounted on the linear ram 18. Thus, with the components in the position shown the impact hammer 20 is actuated causing the piston 122 to impact the linear ram 18. The impact propels the linear ram 18 forward causing the tip 93 to deliver high impact energy into the material being ripped. This impacting will be repeated until the material fractures. When the material fractures the linear ram 18 is allowed to move further forward until the rear stops 88 of the linear ram 18 contact the pins 90 to limit forward movement of the linear ram 18.

In view of the foregoing, it is readily apparent that the structure of the present invention provides an improved impact ripper apparatus which utilizes an impact hammer having one end resiliently mounted on a support structure and the other end slidably mounted on a linear ram to reduce the vibrations transmitted to the mounting frame and also provide for ease of service and reduce maintenance cost and still maintain alignment of the separate parts and allow for the connection area to be sealed.

Other aspects, objects, and advantages of this invention can be obtained from a study of the drawing, the disclosure and the appended claims.

I claim:

1. An impact ripper apparatus comprising:

a mounting frame;

a tool holder having a first end portion attached to the mounting frame and a second end portion projecting therefrom, the second end portion having a bore therethrough;

a linear ram reciprocatingly supported within the bore; and an impact hammer having a piston coaxially aligned with the bore, a first end portion resiliently mounted to the mounting frame, and a second end portion mounted on one of the linear ram and the second end portion of the tool holder, the impact hammer being positioned for the piston to deliver impact blows to the linear ram.

2. The impact ripper apparatus of claim 1 wherein the tool holder includes first and second bearings, the linear ram being reciprocatingly supported within the first and second bearings.

3. The impact ripper apparatus of claim 2 wherein the second bearing has a portion extending toward the impact hammer, and including a seal positioned between the second end portion of the impact hammer and the extending portion of the second bearing.

4. The impact ripper apparatus of claim 3 including a plurality of resilient mounting structures disposed between the first end portion of the impact hammer and the mounting frame.

5. The impact ripper apparatus of claim 4 wherein the second end portion of the impact hammer includes a bearing slidably supported on the linear ram.

6. The impact ripper apparatus of claim 5 wherein the seal includes an elastomeric ring.

7. The impact ripper apparatus of claim 1 wherein the impact hammer includes a bore and the linear ram includes a portion extending into the bore and the impact hammer is supported on the extending portion.

* * * * *